US005782119A

United States Patent [19]

Ellis et al.

[11] Patent Number: 5,782,119

[45] Date of Patent: Jul. 21, 1998

[54] BIASED DETENT FOR DOOR KNOB ASSEMBLY

[75] Inventors: Philip C. Ellis, Reading; Leslie A. Meck, Fleetwood, both of Pa.

[73] Assignee: Baldwin Hardware Corporation, Reading, Pa.

[21] Appl. No.: 684,158

[22] Filed: Jul. 19, 1996

[51] Int. Cl.[6] ..... E05B 9/04

[52] U.S. Cl. ..... 70/371; 70/DIG. 39; 70/368

[58] Field of Search ..... 70/224, 368, 371, 70/DIG. 39; 292/352, 348, 467, 468, 469, 470, 471, 472, 473, 474, 475, 476, 477, 478, 479, 480–484

[56] References Cited

U.S. PATENT DOCUMENTS

| | | | |
|---|---|---|---|
| 508,267 | 11/1893 | Armstrong | 70/469 |
| 2,301,751 | 11/1942 | Schlage | 70/224 |
| 3,212,306 | 10/1965 | Russell et al. | 70/224 |
| 3,402,582 | 9/1968 | Jacobi | 70/371 |
| 4,195,503 | 4/1980 | Roberts | 70/371 |
| 4,428,570 | 1/1984 | Foshee et al. | 70/224 |
| 4,966,399 | 10/1990 | Lin | 292/359 |
| 4,995,249 | 2/1991 | Preissler et al. | 70/224 |
| 5,077,994 | 1/1992 | Trull et al. | 70/371 |
| 5,317,889 | 6/1994 | Solovieff et al. | 70/371 |
| 5,450,737 | 9/1995 | Sasaki | 70/224 |

*Primary Examiner*—Suzanne Dino Barrett
*Assistant Examiner*—Tuyet-Phuong Pham
*Attorney, Agent, or Firm*—Edgar A. Zarins; Malcolm L. Sutherland

[57] ABSTRACT

A spring-biased detent to provide selective securement of a door knob assembly to a spindle of a lock mechanism. The detent is inserted transversely in the spindle and biased by a spring clip. The detent may be depressed within the spindle allowing the door knob assembly to slide onto the spindle and subsequently is biased into an aperture of the knob to lockingly attach the knob assembly to the spindle. The detent includes a central aperture for receiving a tailpiece of the lock mechanism. The aperture is configured to allow depression of the detent only when the tailpiece is oriented in an unlocked position preventing removal of the door knob assembly when the latch is locked.

3 Claims, 2 Drawing Sheets

BIASED DETENT FOR DOOR KNOB ASSEMBLY

BACKGROUND OF THE INVENTION

I. Field of the Invention

This invention relates to a spring-biased detent for securing a door knob to a lock spindle and, in particular, to a biased detent which prevents removal of the door knob when the lock mechanism is locked.

II. Description of the Prior Art

In ANSI Series 4000 bored through locks, the lock cylinder is disposed within the outside knob or lever assembly. Typically, these locks are constructed to allow removal of the lock cylinder for rekeying. The knob is removed from the lock assembly exposing the cylinder which can be extracted for rekeying. Currently, the most common method of facilitating removal of the knob is by boring the inside of the knob to fit over a lock spindle which contains the cylinder and the locking mechanism. The knob is held on the spindle by a spring-loaded detent which engages a slot in the knob shank and prevents axial movement of the knob relative to the spindle. A hole through the knob shank provides access to depress the detent releasing the knob from the spindle.

While this access to the lock cylinder does not present a problem in interior lock sets, it is desirable to prevent removal of the knob when an entry door is locked by an entry set. Preferably, it is desirable to prevent the knob from being removed without a key which operates the lock.

SUMMARY OF THE PRESENT INVENTION

The present invention overcomes the disadvantages of the prior known lock sets by providing a spring-biased detent for securing the door knob assembly and configured to prevent removal of the door knob when the door is locked to prevent entry.

A lock assembly mounted to a door includes an internal lock mechanism with a lock spindle extending perpendicular to the door. An internal drive tube transmits rotation of the lock spindle to a latch bolt extending into the door jamb. A tailpiece extends coaxially through the drive tube and lock mechanism to selectively lock the mechanism against operation. A spring-biased detent extends transversely through the spindle and includes a head which protrudes from the spindle. The head is ramped facilitating depression as the knob trim is slid onto the spindle and is biased into an aperture in the knob upon complete insertion of the knob to secure the knob on the lock spindle. Depression of the detent allows removal of the door knob.

The spring-biased detent includes a keyhole aperture with a round portion on the axis of rotation of the spindle and a slot portion aligned with the direction of movement of the detent. The tailpiece attached to the turn button in the inside knob engages or releases the locking mechanism and passes through the detent aperture and rotates freely in the round portion of the aperture. However, when the tailpiece is parallel to the slot portion, as it is when the locking mechanism is released, the detent can be depressed for removal of the knob. When the tailpiece is perpendicular to the slot portion, as it is when the locking mechanism is engaged, the detent cannot be depressed. As a further safeguard against removal of the door knob, the key is required. The detent includes a perpendicular flange extending toward the lock cylinder. When the cylinder plug is in its normal position, the cylinder cam interferes with the flange in the detent preventing depression. When the cylinder plug is rotated using the key, the detent flange is aligned with a slot in the cam allowing depression of the detent. Thus, the detent incorporates two separate features to prevent depression against the spring clip and removal of the door knob.

Other objects, features and advantages of the invention will be apparent from the following detailed description taken in connection with the accompany drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED Embodiment Of The Present Invention

Figure 1:
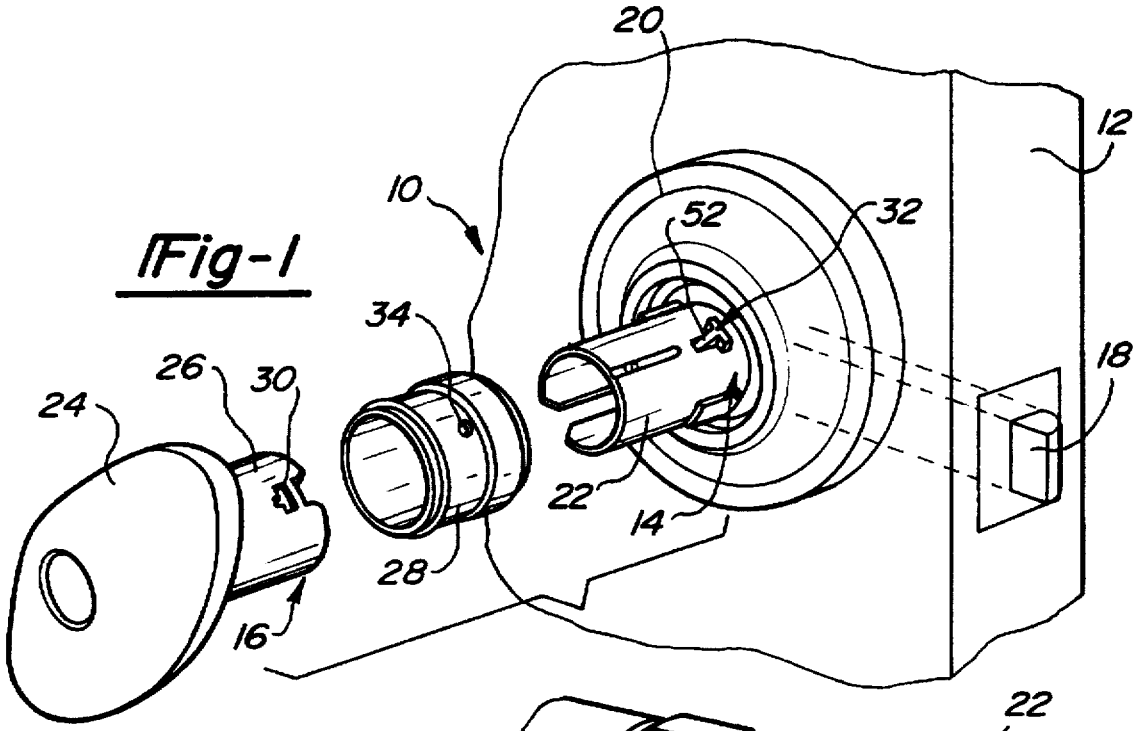
FIG. 1 is an exploded perspective view of a lock assembly embodying the present invention.
Figure 2:
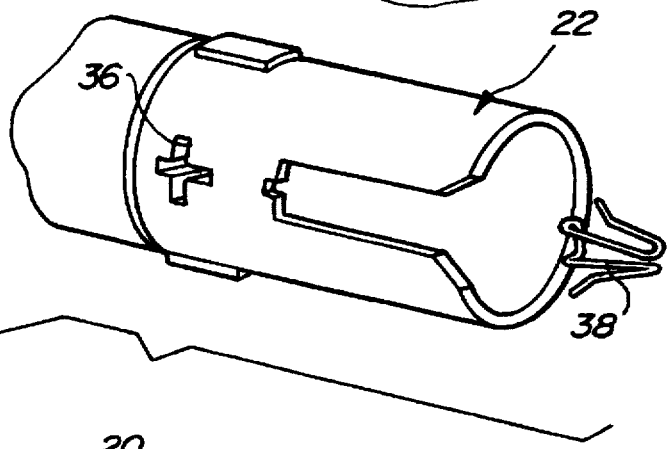
FIG. 2 is an exploded view of a lock spindle incorporating a spring-biased detent of the present invention.
Figure 2:
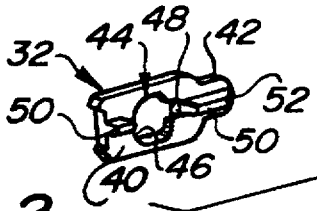
Figure 3:
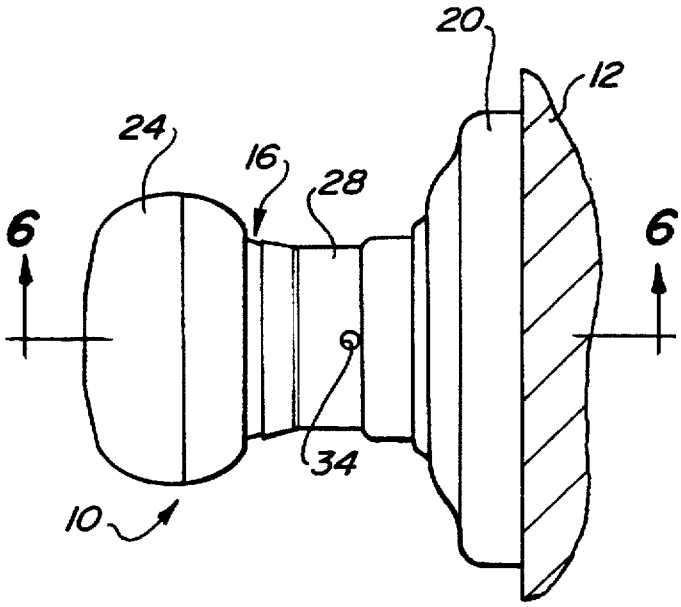
FIG. 3 is a side view of the lock assembly.

Referring first to FIGS. 1 through 3, there is shown a lock assembly 10 for a door 12 to selectively control passage through a door passageway. The lock assembly 10 includes a lock mechanism 14 mounted within the door 12 and operably connected to a knob assembly 16 for selective deployment of a latch bolt 18 to open and close the door 12. As is well known, when the lock assembly 10 is unlocked, rotation of the door knob assembly 16 will retract and extend the bolt 18 accordingly. While the present invention will be described in connection with a door knob, it is to be understood that a knob of any configuration or a lever could be used with the lock assembly 10. An escutcheon 20 is mounted to the lock assembly 10 to conceal the locking mechanism within the door 12.

The lock mechanism 14 includes a lock spindle 22 extending perpendicular to the door 12. The lock spindle 22 has a tubular configuration and is adapted to receive the knob assembly 16. The knob assembly 16 includes a knob body 24 having a tubular shank 26 extending therefrom and a trim component or shank cover 28 for concealing the shank 26 and lock spindle 22 providing a decorative appearance. The shank 26 has at least one aperture 30 for receiving a spring-biased detent 32 mounted in the lock spindle 22 to selectively prevent removal of the door knob assembly 16 from the spindle 22 as will be subsequently described. The shank aperture 30 is configured to receive the detent 32. An aperture 34 in the shank cover 28 provides access to the detent 32 once the lock is assembled on the door 12.

The lock spindle 22 includes a correspondingly configured opening 36 to receive the detent 32 transversely through the side wall of the spindle 22. In a preferred embodiment, the opening 36 is cross-shaped to accommodate the perpendicular flanges of the detent 32. A spring clip 38 biasingly retains the detent 32 within the spindle 22 allowing selective retraction of the detent 32 into the spindle 22 as will be subsequently described. The detent 32 includes a planar body portion 40 with a reduced width tip 42. An aperture 44 is formed in the body 40 to accommodate the lock mechanism. In a preferred embodiment, the aperture 44 has a "keyhole" configuration with a substantially round portion 46 and a slot 48. Flanges 50 are formed perpendicular to the body portion 40. An angled forward edge 52 of the flange 50 facilitates engagement with the knob assembly 16.

The detent 32 of the present invention prevents removal of the knob assembly 16 unless the lock mechanism is unlocked and the key is inserted within a lock cylinder 60. A tailpiece 62 of the lock mechanism 14 extends between the inner door knob through the detent 32 into the lock cylinder 60. The lock cylinder 60 is disposed within the hollow door knob assembly 16 and the spindle 22. 22. Accordingly, upon removal of the door knob assembly 16 the lock cylinder 60 can be removed for rekeying.

Figure 4:
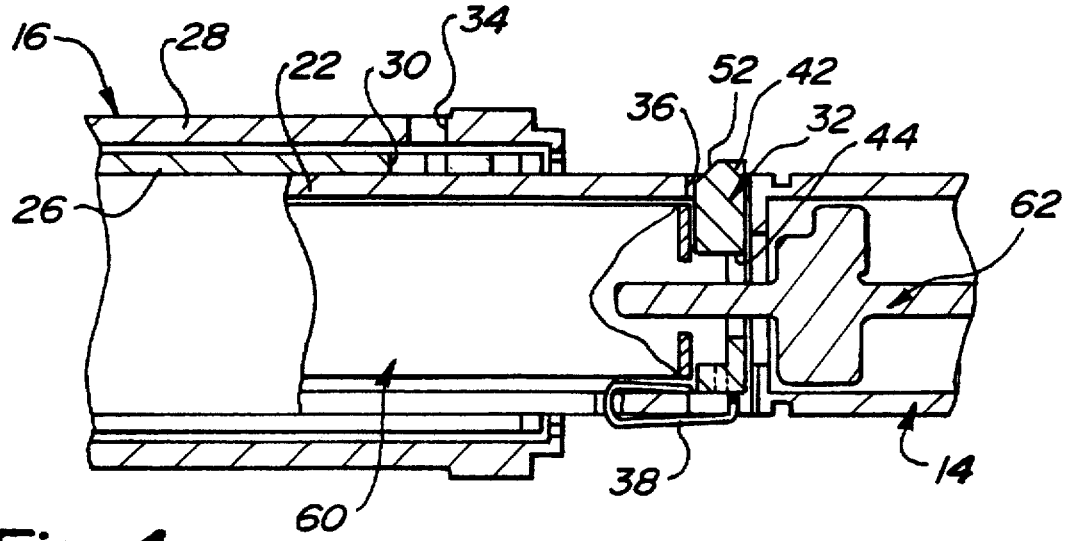
FIG. 4 is a partial cross-sectional view showing the door knob assembly sliding onto the spindle.
Figure 5:
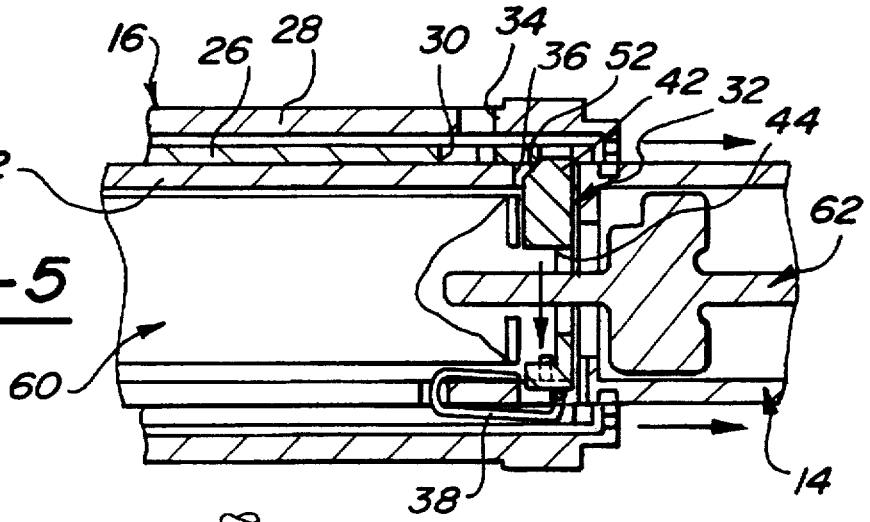
FIG. 5 is a partial cross-sectional view showing the door knob assembly sliding onto the spindle and the detent depressed.
Figure 6:
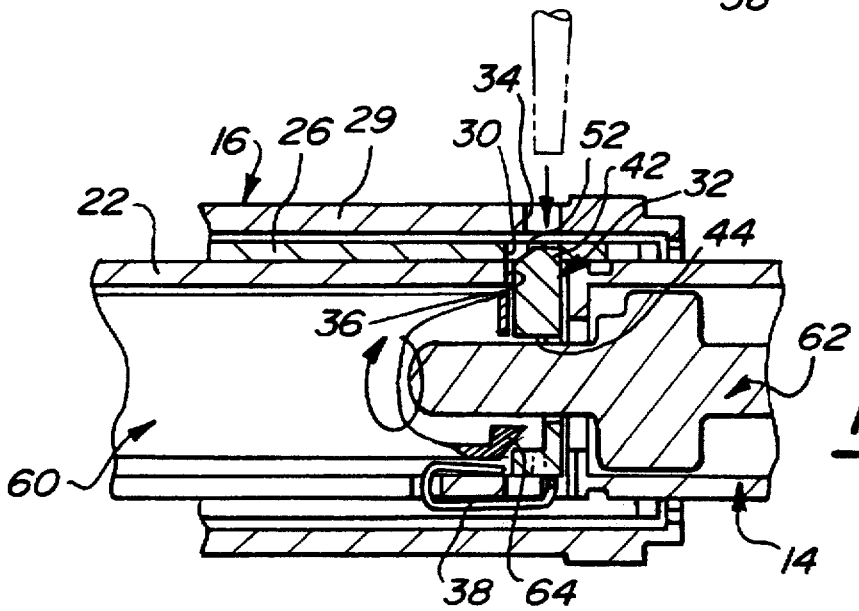
FIG. 6 is a partial cross-sectional view of the door knob assembly secured by the biased detent.

Referring now to FIGS. 4 through 6, the detent 32 is positioned transversely within the lock spindle 22 and having the tailpiece 62 extending through the aperture 44 of the detent 32. The tailpiece 62 has a substantially planar configuration such that one transverse dimension, i.e. the width, is greater than the other transverse dimension, i.e. the thickness, such that operation of either the interior or exterior lock is translated to the other lock. In order to attach the door knob assembly 16 to the lock mechanism 14, the shank 26 is matingly slipped over the spindle 22. As the knob assembly 16 is slid along the spindle 22, a forward edge of the door knob 16 engages the sloped edge 52 of the detent 32 depressing the detent 32 transversely against the bias of the spring clip 38. The shank 26 travels over the detent 32 until the detent 32 extends into the aperture 30 in the shank 26 preventing further movement of the door knob assembly 16.

The detent 32, in conjunction with the lock cylinder 60 and tailpiece 62, prevents removal of the door knob assembly 16. The tailpiece 62 extends through the keyhole aperture 44 of the detent 32. The round portion 46 of the aperture 44 is aligned with the axis of rotation of the tailpiece 62. Rotation of the tailpiece 62 engages or releases the locking mechanism. The slotted portion 48 of the aperture 44 is slightly wider than the thickness of the tailpiece 62 but narrower than the width of the tailpiece 62. Accordingly, when the tailpiece is parallel to the slot 48 of the aperture 44 as it is when the locking mechanism 14 is released (FIG. 6), the detent 32 can be depressed against the spring 38 and the knob 16 removed. When the width of the tailpiece 62 is perpendicular to the slot 48 of the aperture 44, as it is when the lock is engaged (FIG. 4), the detent 32 is prevented from moving and cannot be depressed. As a result, the detent 32 remains within the opening 30 of the shank 26 preventing removal of the knob 16.

Since the detent 32 can be depressed against the spring clip 38 whenever the width of the tailpiece 62 is parallel to the slot portion 48 of the detent aperture 44 when the lock mechanism 14 is unlocked, it would not be necessary to have a key to remove the door knob 16 if the door is unlocked. To overcome this feature, the perpendicular flange 50 extends toward the lock cylinder 60 for selective engagement by a cylinder cam 64. When the lock cylinder 60 is in its normal position, the cylinder cam 64 interferes with the flange 50 of the detent 32 preventing depression of the detent 32 within the spindle 22. The cylinder cam 64 has a transverse slot 66 wider than the thickness of the detent flange 50 and perpendicular to the direction of movement of the detent 32. When the lock cylinder 60 is rotated approximately 90 degrees, which requires a key, the flange 50 of the detent 32 aligns with the slot 66 of the cam 64 permitting depression of the detent 32. Accordingly, removal of the door knob assembly 16 can only be accomplished when the tailpiece 62 is in the unlocked position and the lock cylinder 60 has been rotated to allow depression of the detent 32 laterally against the bias of the spring clip 38 and subsequent longitudinal movement of the door knob assembly 16. Of course, it is within the scope of the present invention that either of the structural features preventing depression of the detent 32 could be incorporated independent of the other to retard removal of the door knob.

The foregoing detailed description has been given for clearness of understanding only and no unnecessary limitations should be understood therefrom as some modifications will be obvious to those skilled in the art without departing from the scope and spirit of the appended claims.

What is claimed is:

1. In a lock mechanism having a lock cylinder with a tailpiece operably connected to the lock cylinder and a lock spindle with a door knob assembly detachably mounted to the lock spindle, the tailpiece rotatable between a first locked orientation and a second unlocked orientation and the lock cylinder movable between a first locked orientation and a second unlocked orientation the improvement comprising:

a spring-biased detent for detachably mounting the door knob assembly to the lock spindle, said detent having a substantially planar body portion with a reduced width end;

said body portion having a keyhole aperture receiving the tailpiece of the lock mechanism, said keyhole aperture oriented axially within said body portion and including a round portion and a slot portion extending from said round portion along a longitudinal axis of said body whereby longitudinal movement of said detent is prevented with the tailpiece in the first orientation and said detent selectively depressible with the tailpiece aligned with said longitudinal slot portion in the second unlocked orientation; and said body portion having at least one flange formed perpendicular thereto and selectively engaging the lock cylinder, the lock cylinder including means for selectively blocking movement of said detent whereby longitudinal movement of said detent is prevented by said blocking means on said lock cylinder with the lock cylinder in a first locked orientation and said detent selectively depressible past said blocking means with the lock cylinder in a second unlocked position.

2. The improvement as defined in claim 1 further comprising a second flange having a sloped leading edge forming a ramp such that engagement by the door knob assembly depresses said detent into the spindle.

3. The improvement as defined in claim 2 wherein said means for selectively blocking movement of said detent includes a slotted cam formed in said lock cylinder, said at least one flange of said detent extending through said slot of said lock cylinder cam with said lock cylinder in said second unlocked orientation to facilitate depression of said detent.

* * * * *